United States Patent [19]

Rose et al.

[11] Patent Number: 4,517,253

[45] Date of Patent: May 14, 1985

[54] CRYOELECTRODEPOSITION

[76] Inventors: Robert M. Rose, 18 Morgan St., Wenham, Mass. 01984; Donald R. Sadoway, 53 Vernon Rd., Belmont, Mass. 02178

[21] Appl. No.: 572,822

[22] Filed: Jan. 23, 1984

[51] Int. Cl.[3] ..... C25B 1/00

[52] U.S. Cl. ..... 428/620; 428/637; 428/638; 428/641; 428/642; 428/646; 428/650; 428/653; 428/684; 204/58.5

[58] Field of Search ..... 204/58.5, 1 T, 228; 75/107; 428/620, 637, 638, 641, 642, 646, 650, 653, 684

[56] References Cited

U.S. PATENT DOCUMENTS

| | | | |
|---|---|---|---|
| 3,778,360 | 12/1973 | Gordy | 204/107 |
| 3,990,953 | 11/1976 | Austin | 204/14 N |
| 4,152,220 | 5/1979 | Wong | 204/58.5 |
| 4,192,720 | 3/1980 | Bucher et al. | 204/14 N |
| 4,227,291 | 10/1980 | Schumacher | 29/572 |
| 4,417,954 | 11/1983 | Birkle et al. | 204/58.5 |

FOREIGN PATENT DOCUMENTS

| | | | |
|---|---|---|---|
| 231657 | 6/1910 | Fed. Rep. of Germany | 204/14 N |
| 237014 | 6/1910 | Fed. Rep. of Germany | 204/14 N |
| 17190 | of 1896 | United Kingdom | 75/107 |
| 320818 | 10/1929 | United Kingdom | 204/14 N |

OTHER PUBLICATIONS

"An Introd. to Metallurgy", by A. H. Cottrell, Christs College, Cambridge, Edward Arnold Ltd., London, 1968, pp. 81–82, 93, 117–121, 545.

"Table of Periodic Props. of the Elements", Sargent-Welch Co., 1979.

"Furfural as a Possible Ionizing Medium", by J. R. McKee et al., 53rd General Meet. A.E.S., 4–27–1928, pp. 333–351.

"An Attempt to Electroplate W on Fe", by C. A. Mann et al., 45th General Meet. A.E.S., 4–26–1924, pp. 493–511.

"Versuche zur Abscheidung von W aus W Salzlüngen", von B. Neumann et al., Zelschrift für Elektrochemie Bd. 30, 1924, pp. 474–475.

"Electrod. of W from Aqueous Sol'ns, by C. G. Fink et al., 59th Gen. Meet. E.C.S., 4–25–31, pp. 461–481.

"Electrodep. of Metals fr. Organic Solutions", by Abner Brenner, J. E.C.S., 12–1956, pp. 652–656.

"Electrodep. of Metals fr. Organic Solutions", by W. E. Reid et al., J. E.C.S., 1–1957, pp. 21–29.

"Cathodic Dep. of Amorphous Si. fr. Tetraethylorthosilicate in Organic Solvents", by T. R. Mohan et al., J. E.C.S., 6–81, pp. 1221–1224.

"Cathodic Dep. of Amorphous Alloys of Si, C, & F, by C. H. Lee et al., J. E.C.S., 5–1982, pp. 936–942.

"Electrodep. Studies of Mo, W, and V, in Org. Solvents", by R. E. Meredith et al., U.S. Bur. Mines Dept. Invest. 6303, 1963.

"Electroplating of W from Non-Aqueous Lewis Acid Sol'ns", by F. D. Hess et al., Aerospace Corp., Contract No. AF 04(695)-69, Aug. 1, 1962.

"Electrodep. of Mo", by T. T. Campbell, J. E.C.S., vol. 106, #2, 2/1959, pp. 119–123.

"Electrodep. of Metals from Anhydrous $NH_3$", by H. Simmons et al., Thesis, Western Reserve U. Grad. School, pp. 3303–3321.

"Studie Über ein Derivat des Fünfuertigen W", von A. Finker et al., Dissertation, Kgl. Techn. Hochschule Aachen, 1912, pp. 102–115.

"Beiträge zur Elektrochemie der Chromgruppe, W & U", by A. Fischer, pp. 173–215.

"Uber Kathodische Elektroreduktion der Wolframsaive", by A. Rosenheim, VII Internationder Kongress für Angenandte Chemie in London, 6–11–09, pp. 1152–1154.

"Electrolysis of Organic Solvents with Reference to the Electrodeposition of Metals", by Abner Brenner, J. E.C.S., 2–1959, pp. 148–154.

"Periodic Table of the Elements", Sargent & Co.

*Primary Examiner*—R. L. Andrews

*Attorney, Agent, or Firm*—Robert Shaw

[57] ABSTRACT

A process for electrodeposition of a material on a substrate that includes the steps of establishing a liquid halogenous electrolyte containing the material to be plated on the substrate and a solute, said electrolyte having an appropriate electrical conductance in a cryogenic environment; and establishing an electric field within the electrolyte to effect migration of ions of said material to the substrate where they deposit.

51 Claims, 3 Drawing Figures

CRYOELECTRODEPOSITION

The present invention relates to the deposition of reactive materials onto a substrate.

C. H. Lee and F. A. Kroger (J. Electrochem. Soc. 129 (5), 936–942, 1982) have electroplated amorphous silicon containing fluorine and carbon from solutions of $K_2SiF_6$ in acetone with HF at ambient temperatures. These films were doped with boron or phosphorus.

Y. Tokeda, R. Kanno, O. Yamamoto, T. R. R. Mohan, C. H. Lee and F. A. Kroger (J. Electrochem. Soc. 128 (6), 1221–1224, 1981) describe the deposition of amorphous silicon on nickel cathodes by use of a solution of tetraethylorthosilicate in acetic acid at 295° K.

U.S. Pat. No. 4,192,720 describes a method for plating amorphous silicon from solutions of silane or hydrogenated silanes or silicon halides in organic solvents such as tetrahydrofuran, 50/50 dioxolane-toluene, etc. with salts added to improve conductivity.

U.S. Pat. No. 4,227,291 described the electroplating of silicon using electrolytes of the general formula $MH_{4-n}X_n$ where M is germanium or silicon and X is a halogen, doped with phosphorus compounds such as $PBr_3$. A sacrificial anode is used in this process.

The deposition of silicon from organic solvents below 100° C. is described by A. E. Austin (U.S. Pat. No. 3,990,953, Nov. 9, 1976), using (typically) $SiCl_4$ or $SiHCl_3$ dissolved in the solvent.

W. E. Reid Jr., J. M. Bish and Abner Brenner (J. Electrochem. Soc. 104, 21–29, 1957) describe attempts at the electrodeposition of titanium and zirconium at ambient temperature from organic solutions, e.g., ethyl ethers, using halide salts of Ti and Zr. These efforts were not successful, but alloy deposits were obtained. An earlier paper by Brenner (J. Electrochem. Soc. 103, 652–656, 1956) described the general principles of electrodeposition od metals from organic solutions at room temperature; a later paper (J. Electrochem. Soc. 106, 148–154, 1959) contains a similar discussion, in which failed attempts at plating molybdenum are described.

Early attempts at deposition of tungsten at low temperatures were:

Rosenheim, Z. Angew, Chem. 22 (1909) 1153: electrolysis of tungstic acid in alcohol saturated with hydrochloric acid; German Pat. No. 231,657 (1910): electrolysis of pertungstic acid in various solvents; Fischer, Z. Anorg. Chem. 81 (1913) 170; Fischer, Z. Anorg. Chem. 81 (1913) 102: attempted to use the method described in the above Pat. No. 231,657 and failed; German Pat. No. 237,014 (1920): deals with deposition using tungsten salts in acetone and similar solvents; Fink (Trans. Electrochem. Soc. 59 461, 1931) used the methods described by both Pat. Nos. 231,657 and 237,104 (both failed to produce a tungsten deposit).

Other failures were described by Neumann and Rickter (Z. Elektrochem. 30, 474, 1924): tungsten hexachloride in acetone, pyridine and glycerine; Mann and Halvoren (Trans. Electrochem. Soc. 45, 13, 1945): tungsten hexachloride in various organic solvents; McKee, Mann and Montillan (Trans. Amer. Electrochem. Soc. 53, 533, 1928): tried ammonium iodide in furfural as electrolyte and a tungsten anode; British Pat. No. 320,818 (1928) described electrolysis of tungsten salts in liquid ammonia; however, Booth and Merlub-Sobel (J. Phys. Chem. 35, 3303, 1931) tried electrolysis of tungsten pentabromide in liquid ammonia, with no results.

Failures involving both molybdenum and tungsten include: H. B. Jonassen, Frankford Arsenal Contract No. DA-009-ORD-447 (final report Mar. 12, 1957): tried a large number of molybdenum and tungsten compounds in organic and inorganic solvents; T. T. Campbell (J. Electrochem. Soc. 106, 119, 1960): tried $MoCl_5$, $MoCl_3$ and $MoBr_3$ in a variety of solvents, mostly organic; F. D. Hess and L. Schieler (Aerospace Corp., Los Angeles, Calif. Report AD 283 341 Div. 4, 17, 1962): dissolved tungsten hexachloride and tungsten hexafluoride in a large number of organic solvents; and R. E. Meredith and T. T. Campbell (presentation at 1963 Electrochemical Society Meeting, New York, September 30–October 3): tried bromide and chloride salts of molybdenum, tungsten and vanadium in organic solvents; again with no success.

The foregoing teachings disclose, among other things, the deposition of silicon and silicon alloys from organic solvents seeded with $SiF_4$ or $SiCl_4$, $Si(OCH_2CH_3)_4$, Si(OEt). In the discussion that follows emphasis is placed on the present invention in the context of refractory metals applied as thin coatings on a substrate.

The formation of thin coatings of the refractory metals is an especially difficult problem. Only chromium, of all the metals from groups IVA-VIA of the periodic table, can be electroplated in aqueous media. For the others, fused salt deposition, chemical vapor deposition, electron beam evaporation or sputtering is used due to the reactivity of these metals. Such difficulties are shared in varying degree by other materials in which thin-film technologies are desirable, e.g., silicon. The difficulties entailed in the prior art processes for refractory metals all have a common thread, in that all are essentially high-temperature processes. The high temperatures induce metastable structures, coalescence (and therefore nonuniformity) of the deposited layers, thermally induced changes in the substrate, and so forth. Only ameliorative measures are possible: for instance, thermalized sputtering at low voltages and high pressures will extend the capabilities of sputtering somewhat. However, the kinetic energies of the atomic clusters descending on the substrate are still considerable.

A related problem is that of preparation of smooth, clean surfaces or interfaces on this group of metals. The cleanup procedures are inevitably high-energy approaches. One of the present inventors (Rose) has extensive experience, for instance, with the preparation of niobium surfaces for superconducting tunnel junctions and also for superconducting resonant cavities for microwave appliations. The state-of-the-art approach consists of annealing very high (2000 degrees C., typically) temperatures or even direct crystal growth from the melt (over 2500 degrees C.), in ultrahigh vacua ($10^{-9}$ torr or better), or evaporation or sputtering with elaborate precautions to avoid contamination. These approaches are, of course, severely limited by practical considerations and also by thermal faceting (limiting smoothness) and by the formation of Gibbs isotherms on cool-down which segregates all residual mobile impurities to the immediate surface.

At this time both IBM and MITI (Japan) appear to be abandoning their major efforts at development of niobium-based Josephson junctions for advanced digital computers. The central problem has been the manufacture of the junction, which is attended with the difficulties mentioned above, plus the interaction of the niobium with the electrical barrier layers around it.

Amorphous metals and semiconductors have remarkable electrical, magnetic and mechanical properties and resistance to oxidation and corrosion. Again, the fabrication technology is in essence high-temperature, including the above-mentioned methods and especially rapid solidification and quenching. The only exception is the deposition of silicon from organic solvents.

Accordingly, it is a principal object of the invention to form thin coatings on a substrate in a way that mitigates or even eliminates the problems encountered when the foreging techniques are employed.

Another object is to provide a novel approach to formation of a refractory or other reactive material onto a substrate.

Still another object is to provide a new class of materials.

A further object is to provide a new method of electrowinning of ultrapure metals and metalloids. (At present, e.g., titanium is obtained by electrothermal reduction of $TiCl_4$ by Ca or Na; fused salt electrowinning has not proceeded beyond pilot scale but is expected to expand in the future as higher purity titanium is required. Silicon has been deposited by the inventors by winning from solution and the method is applicable in general to semiconductors.)

These and still further objects are addressed hereinafter.

The foregoing objects are achieved, generally, in a method of electrodeposition of a reactive material on a substrate, that includes the steps of establishing an anhydrous ion solution of the reactive material in a liquid electrolyte containing the reactive material and at least one of the group consisting of a halogenous compound (liquid or solid), and liquid interhalogen having an appropriate electrical conductance; immersing the substrate in the ion solution; and establishing an electric potential between the ion solution and the substrate to attract reactive material ions in the ion solution to the substrate where they deposit.

BRIEF DESCRIPTION OF THE DRAWING

The invention is hereinafter described with reference to the accompanying drawing in which.

DETAILED DESCRIPTION OF THE DRAWING

Figure 1:
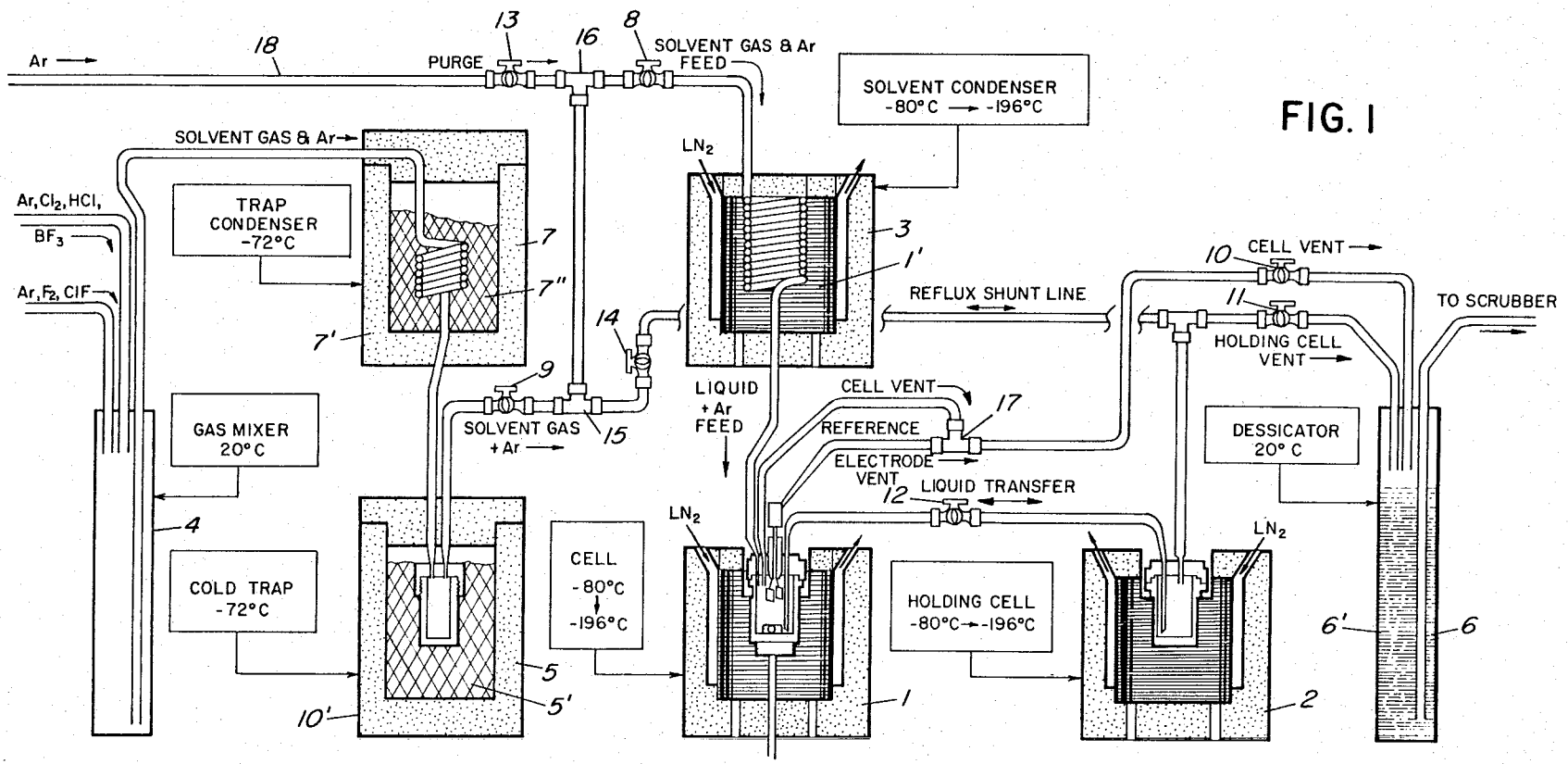
FIG. 1 is a diagrammatic representation of a system to perform the processes herein disclosed, which system includes a main cell in which cryoelectrodeposition is performed, and a holding cell.

Before delving into the precise details of the present invention, it may be useful to discuss the more general aspects thereof. Using the present techniques, the inventors generate a new class of materials by an approach that is fundamentally low temperature and low energy. The approach discussed herein can be used to deposit elemental metals, semiconductors and compounds thereof, at low temperatures with a control of structure that is not possible in higher temperature processes. The thickness can be controlled Coulometrically to within a monolayer.

The method described in greatest detail is electrodeposition at low temperature of Nb and other refractory metals in liquid mixtures containing one or more halogen, interhalogen and halides. A particularly useful solvent is hydrogen fluoride which melts at 184 degrees K. and boils at 293 degrees K. and when potassium fluoride is dissolved in it, behaves very much like a molten salt. ClF, which melts at 117 degrees K. and boils at 173 degrees K. can also be used as it is an excellent ionizing solvent for metal fluorides and has adequate specific conductance. Excellent results have also been obtained with HCl with additives (e.g., $(CH_3)_4NCl$) that increase electrical conductance. Temperatures in the 120–170 degrees K. range are not difficult to maintain and many materials contain the interhalogens (of which ClF is far from the most reactive) adequately. The procedure employed to practice the invention now follows.

The cell (see FIGS. 1 and 2) used to practice the invention was cleaned thoroughly before each run. Fluorocarbon parts which were to come in contact with the plating were cleaned by soaking in a mixture of equal parts of concentrated $HNO_3$, HCl and $H_2SO_4$ for ten minutes. Brass parts and fluorocarbon parts not to be in contact with the solution were scrubbed with dilute HCl (5% aqueous). All parts were then rinsed first with distilled water and then alcohol, and wiped dry; this was followed by drying in a vacuum chamber. Electrodes were prepared in the manner now discussed.

Cathode (tantalum): A piece of tantalum (Ta) foil $0.010'' \times \frac{1}{2}'' \times \frac{1}{2}''$ was spot-welded to a 24-gauge niobium wire. Two 0.020-inch holes were drilled in the Ta to attach the reference electrode. On all runs except one, the Ta was electropolished in a mixture of nine parts concentrated $H_2SO_4$ and one part HF at 0.3 amp/cm$^2$ for 1–2 minutes. The Nb leads were masked with asphaltum (a tar derivative which could later be washed off with trichloroethylene). Nickel cathodes were prepared by the following procedure: a 1 cm$\times$1 cm square of 0.015-inch Ni sheet was buffed with steel wood and spot-welded to a 24-ga. Ni wire. All of the electrode was cleaned thoroughly and all but the front surface was masked with asphaltum. It was electropolished in a solution consisting of 4 parts $H_2SO_4$, 3 parts distilled $H_2O$ at a current density of 0.4–0.8 A/cm$^2$ for 10 minutes as the bath was agitated. Polished electrodes were immediately covered with the asphaltum and stored thus until needed. When they were to be inserted into the cell they were rinsed with trichloroethylene to remove the asphaltum.

Anode: A piece of platinum foil 0.025 cm$\times$1 cm$\times$1 cm was spot-welded to a 24-ga. niobium wire as above. The same coupon was used alternately as a cathode for Ta electropolishing and as an anode in the cryogenic solvent. Prior to inserting this electrode into the cell, it was scoured lightly with steel wool and rinsed thoroughly with alcohol.

Reference electrode: On runs using HCl as a solvent, reference electrodes were prepared by taking a 0.5 mm silver wire 10 inches long and anodizing it in 0.1 molar HCl at 0.4 milliamperes per cm$^2$ for about half an hour. This created an Ag/AgCl couple which functioned as a reference electrode. The wire was cleaned thoroughly before and after anodizing with distilled water and alcohol and finally inserted into the reference capillary tube in the electrode holder. For runs using a fluoride solvent, a clean piece of 0.015-inch Ni wire functioned as a reference electrode. The Teflon reference probe containing the wire was bent so it rested against the cathode between the two 0.020-inch diameter holes and was tied on using a 0.015" niobium or Ni wire.

Once the cell and electrodes had been prepared in this manner, they were placed in a glove box containing an atmosphere of argon purified to 1 ppm of both $O_2$ and $H_2O$. Inside the glove box the nonvolatile solids would be added which would constitute the plating solution. These solids are referred to below as the salts, although not all of them can be described as "salts" in the strictest sense of the word.

Composition of the "salts": the plating solutions all contained three substances:

1. A salt of the general formula $K_nMX_6$ where M is the metal to be plated, X is a halide, either F or Cl and $n=6-z$, where z is the valence of the metal M. Salts of this type used on different runs were: $KNbCl_6$, $K_2ZrCl_6$, $K_2ZrF_6$, $K_2TiF_6$, $K_2SiF_6$ and $K_3MoCl_6$. Other solutes which have proved successful are oxides, e.g., $Na_2WO_4$ and organometallics, e.g., $Nb(OCH_2CH_3)_5$. Many of these materials are very hygroscopic. One-half to one gram of this "salt" was used, depending on the estimate of water content.

2. A basic salt in the solvent system to be used in runs where ClF or $F_2$ are to come in contact with the salts, KF is used. Otherwise, a tetramethylammonium salt, either $(CH_3)_4NF$ or $(CH_3)_4NBF_4$ or $(CH_3)_4NCl$ which had been baked under a vacuum for 24 hours prior to insertion in the glove box to remove water of hydration. 0.10 grams of this "salt" was used on each run. In runs using HF as a solvent up to 35 mole % KF was added as $KHF_2$ in crystalline form.

3. Sometimes a metallic powder or fine wire of the appropriate metal: Nb metal or Nb runs, Zr metal on Zr runs, and so forth. 0.5 gram was generally used on each run.

The gas system was thoroughly purged with argon. The cell was transported from the glove box to the gas system inside a desiccator. The cell was placed inside a styrofoam-jacketed copper chill underneath the gas condenser and connected to the system. Tube connections were tightened with pliers, and electrical connections (except the thermocouple) were made to brass binding posts inside of a container which would seal over the wires. This was to prevent corrosion of the contacts from gas leaks. The cold trap was cooled to −72 degrees C. using dry ice. The copper chills were cooled to an appropriate temperature in the liquid range of each solvent by adding liquid nitrogen to a hollow space in the insulation next to each chill. The cell was cooled first and tightened with a wrench as it reached its operating temperature. The plastic pieces tended to shrink more than the metal pieces as they became cold, and some of the seals would loosen, causing gas leaks out and water vapor leaks in. The condenser was cooled second and the holding cell last.

Once all of the components of the gas system were at their operating temperatures, the solvent was applied to the system as a gas from a pressurized cylinder. Gases used for solvents were HCl, HF, $BF_3$ and ClF. The rate of flow was controlled with a flow meter and it was applied in rates ranging from 10 $cm^3$/min to 1000 $cm^3$/min. After passing through a dry-ice cold trap which condenses impurities from the gas stream, the gas entered a Monel condenser tube and liquefied (i.e., liquefied gas). A constant flow of gaseous argon drove the liquid down the tube and into the main cell. On runs using hydrogen fluoride as a solvent, it was necessary to mix the gaseous HF with fluorine to remove water from it. Fluorine was also bubbled through the plating solution to remove water from the salts.

The volume of gas necessary to fill the cell with liquid was approximately seventeen liters. The liquid (i.e., liquefied gas) volume was about 40 milliliters. The liquid level in the cell with respect to the electrodes was determined by looking through a port in the copper chill and illuminating the cell from behind. The liquid and salts could be agitated by manipulating a magnet on a rod which drove the Teflon-jacketed magnetic stir bar inside the cell.

The liquid level can also be determined by conductivity measurements between various electrical leads into the cell.

Current can be passed between the anode and the cathode when they are only partially immersed and certain tests were run without ever completely immersing them. I-V (conductometric) measurements required that the reference electrode be immersed but since capillary action carried the solution up into the tube the liquid level never needed to be higher than 5 millimeters above the bottom of the cathode. This also had the effect of focusing the deposits on a small area without greatly decreasing the amount of material which could be plated over time.

I-V measurements were made potentiostatically, by passing current between the anode and the cathode to maintain a constant voltage between the cathode and the reference electrode. A chart recorder measured the current as a function of voltage applied and the voltage was increased incrementally in 50 millivolt steps.

Occasionally, the power supply would be set to pass a constant current in order to deposit "bulk" amounts of material to be observed on the scanning electron microscope (SEM). All I-V curves were drawn from potentiostatic measurements. Sometimes the electrolyte (especially HCl) would become contaminated with water. When this happened, the conductivity of the cell would increase about twenty times and no metal would be deposited. The water had to be removed from the solution by distilling the solvent, otherwise no metal could be deposited. After distilling the solvent from the holding cell through the condenser back into the main cell, metal appeared to deposit normally. Solutions containing $BF_3$ did not become contaminated with water. Water contamination was a chronic problem with HF since most oxides of any kind react to form water in solution. Water could effectively be removed from HF by using fluorine. After a given test the liquid was withdrawn from the cell while current was passing and the cell purged rapidly with argon while the electrodes were removed as quickly as possible from the cell. The solvent was then allowed to evaporate to the scrubber and the entire system was purged thoroughly with argon.

EXAMPLE 1 Nb on Ta

The solution on this run was $KNbCl_6$ and $(CH_3)_4NCl$ saturated in liquid anhydrous HCl; temperature was −93 degrees C.; current averaged around 1.5 milliamperes at 1.8 V with respect to Ni wire.

The deposits formed on the lower 5 millimeters of Ta cathode because the cathode was immersed only that far. Examination revealed the deposits to be patches about 100 micrometers across. The deposits appeared dendritic. The total amount of Nb deposited was approximately 50 micrograms (estimated from relative X-ray intensities from Nb and Ta).

The plating efficiency of this run was approximately 200% with respect to a 5-electron reduction step. Nb wire placed in the solution had apparently reduced some pentavalent Nb which then plated out. For this reason, some pure metal of the element to be plated was placed in the cell for each future run.

EXAMPLE 2 Zr on Ta

After removing the solution to the holding cell and taking out the cathode, the solution was frozen at −130 degrees C while the primary cell was cleaned and dried. The cathode was replaced with a Ta plate and some $K_2ZrCl_6$, $(CH_3)_4NCl$ and Zr powder was added. The holding cell was then heated and the HCl was distilled into the cell again. The conductivity of this solution was very high. I-V measurements were made and then galvanostatic measurements at 40 milliamperes (7 volts with respect to Ag/AgCl). There were some deposits that contained Zr and some that contained Nb. All contained some Cl. The Nb-containing deposit has the same ratio of intensities between Nb and Cl as a hydrolyzed specimen of $KNbCl_6$. Therefore, it must have been hydrolyzed Nb salt which did not wash out between runs. The Zr-containing deposit had a bit less Cl then Zr but the feature charged over time, indicating that it was nonmetallic. Evidently, there was water which remained in the cell after drying (by gassing with room temperature HCl) which raised the conductivity by breaking down to $H_2$ and $O_2$ and probably hydrolyzed the $K_2ZrCl_6$ as well.

EXAMPLE 3 Si on Pt

The electrolyte consisted of 1.00 g $K_2SiF_6$ (dried with $SiCl_4$) and 0.01 g $(CH_3)_4NF$ in pure $BF_3$. Because the electrode leads were accidentally switched, the cathode was platinum and the anode was nickel. The conductivity was very low in this cell. The maximum current was 50 microamperes.

The scanning electron microscope revealed small, plate-like deposits of silicon as well as nonconductive rough deposits containing much of potassium, probably as KF with small amounts of $K_2SiF_6$.

EXAMPLE 4 Mo on Ni

The salt used was $K_3MoCl_6$ in a solution of HCl with a small amount of $BF_3$. The current ranged from 50 to 150 microamperes over about 4 hours.

The deposits found were confined to patches approximately 200–300 micrometers across, and appeared dendritic. They did not charge under the electron beam indicating that they were in firm contact with the substrate.

EXAMPLE 5 W on C

The solute was $Na_2WO_4$ in pure HCl. The solution was contaminated with water at the beginning. The water was removed by repeatedly rinsing the cell with liquid HCl. Through this procedure, the conductivity dropped from 7 milliamperes at 5 volts to 0.075 milliamperes at 4.2 volts. The substrate was a piece of graphite 1 cm×1 cm×0.2 cm which had been polished. Upon removal it appeared to have been etched by the solution. Under the SEM (scanning electron microscope) the substrate appeared very rough, and an elemental map revealed tungsten distributed evenly over the surface of the substrate. The texture of the substrate was so rough that it was impossible to distinguish any deposits of tungsten.

EXAMPLE 6 Si on Ni

Silicon was deposited from a solution of $K_2SiF_6$ and $(CH_3)_4NF$ in $BF_3$. The cell was purged with Argon at the end of the run and left to warm up overnight. Silicon deposits 1000–5000 nanometers thick were observed in rounded patches 0.1–1 micrometer across. The charging rate in the electron microscope indicated extreme purity.

EXAMPLE 7 Mo on Ni

Molybdenum was deposited from a solution of $K_3MoCl_6$ and $(CH_3)_4NBF_4$ in HCl. Patchy dendritic deposits Mo 200–300 micrometers across resulted. The crucial problem in deposition of this and other elements was the absence of water; dehydration was absolutely necessary.

EXAMPLE 8 Nb on C

Niobium was deposited from a solution of $Nb(OCH_2CH_3)_5$ and $(CH_3)4NCl$ in a mixture of $BF_3$ and HCl. The niobium deposits observed were highly conductive, thin layers with thicker dendritic regions up to ten micrometers in diameter. The estimated thickness of the deposit is one micrometer. Scanning Auger analysis (AES) revealed oxygen to be present as well. Some expansions and explanation of the foregoing are made in this paragraph. The ion soution used in the electrodeposition process is a liquid halogen (which generally includes liquid interhalogen, e.g., chlorine monofluoride) or a hydrogen halide such as hydrogen chloride to which is added a material which increases the anion concentration and enhances electrical conductivity. The solution is established at a temperature where the solvent is a liquid, as indicated above, e.g., between 110 degrees K. and 380 degrees K. Reactive materials that can be deposited on a substrate in accordance with the present teaching include, but are not restricted to, refractory metals taken from the group consisting of Ti, Zr, Hf, V, Nb, Ta, Cr, Mo and W or metalloids taken from the group consisting of Si, Ge, B, P, Ga and As. Other metals which may be deposited include ruthenium, osmium, rhodium, iridium, palladium, platinum, silver and gold. Other materials include silicides such as $MoSi_2$ and $WSi_2$ to provide a wear-resistant surface on the substrate. The product produced in according to the present teaching is totally free of thermal damage due to depositing of the material on the substrate, and the layer so deposited can be thicker than ten micrometers.

The accompanying drawing represents concepts developed by the present inventors and others. The apparatus disclosed therein was used to test the inventive concepts disclosed herein. It is not believed necessary to discuss in any great detail the apparatus disclosed, particularly in view of the foregoing exhaustive explanation.

The system labeled 101 in FIG. 1 is used to perform electrodeposition in a cryogenic environment. It includes a main cell 1, a holding cell 2, a solvent condenser 3, a premixing chamber 4, a cold trap 5, a desiccator 6, and a cold trap 7. The labels 8–14 designate TFE stoplocks, 15–18 designate TFE union tees and 19 represents one of a number of ¼ inch OD. tubing (TFE or Monel). The label 7' indicates Styrofoam insulation which is used also for the units 1, 2, 3, 5 and 7; 6' indicates a desiccant; 3' represents a copper block (a similar structure is found in the cells 1 and 2); 5' and 7'' indicate dry ice.

Figure 2:
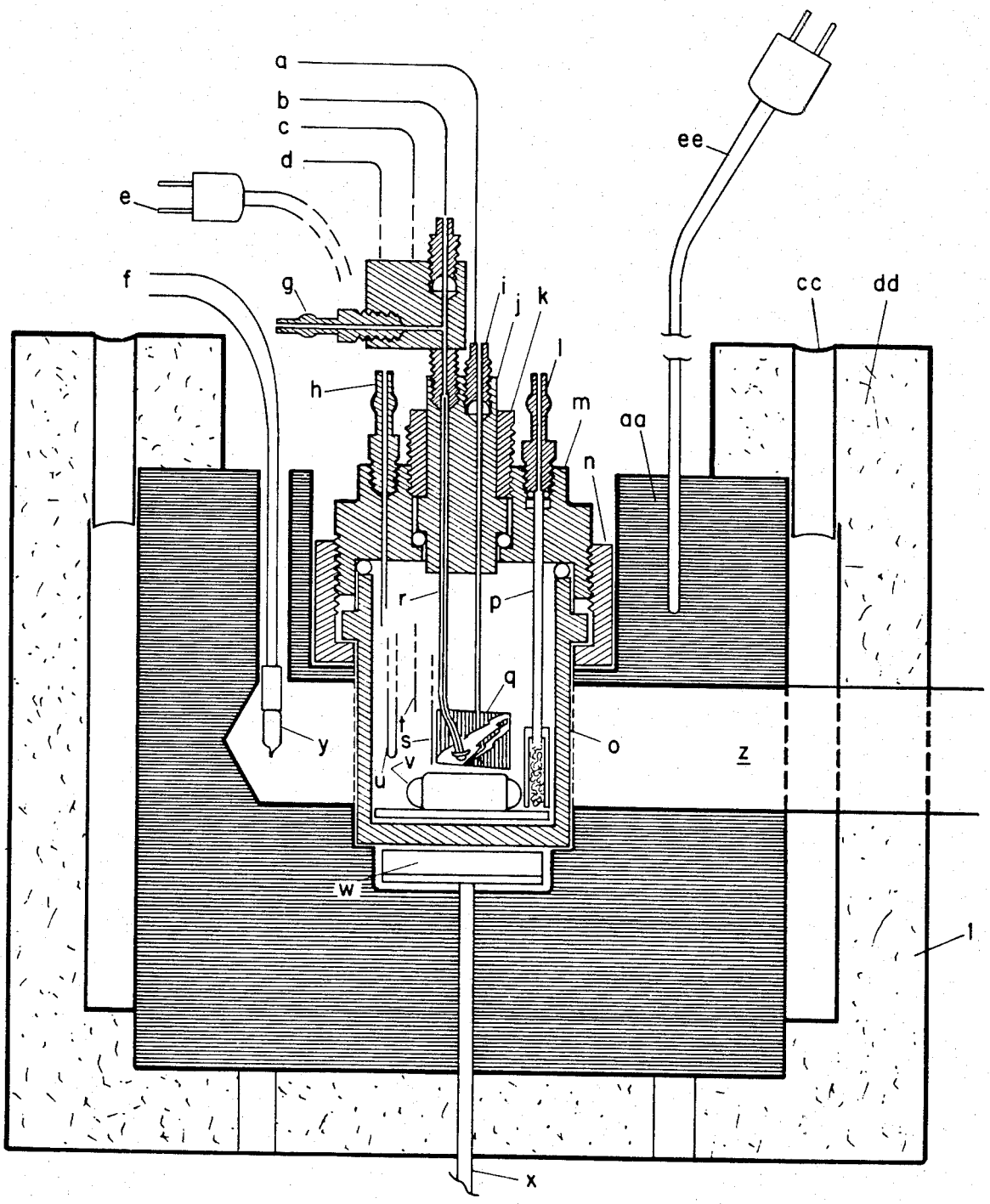
FIG. 2 is a diagrammatic representation of the main cell in FIG. 1.

The main cell 1 in FIG. 2 has a cathode lead a, a reference lead b, and anode lead c, a depth sensor load d, a vent g for the reference electrode, an inlet h for liquid or gas, a cathode lead seal i, an electrode holder j, a brass nut k, a liquid transfer fitting l, a cell cap m which is secured by the brass ring n, a vessel o to contain the electrolyte, a liquid transfer tube p, the cathode q, the reference electrode r, an anode s, a depth sensor t, a thermocouple, the tip of which is indicated by u and which connects to the plug e, a stirring bar v driven by the rotating magnet w connected to the rod x, a light bulb y connected to the leads f, a viewing port z, a copper chill block aa, with another thermocouple ee, a liquid nitrogen inlet bb and vent cc all insulated by Styrofoam insulation dd.

Figure 3:
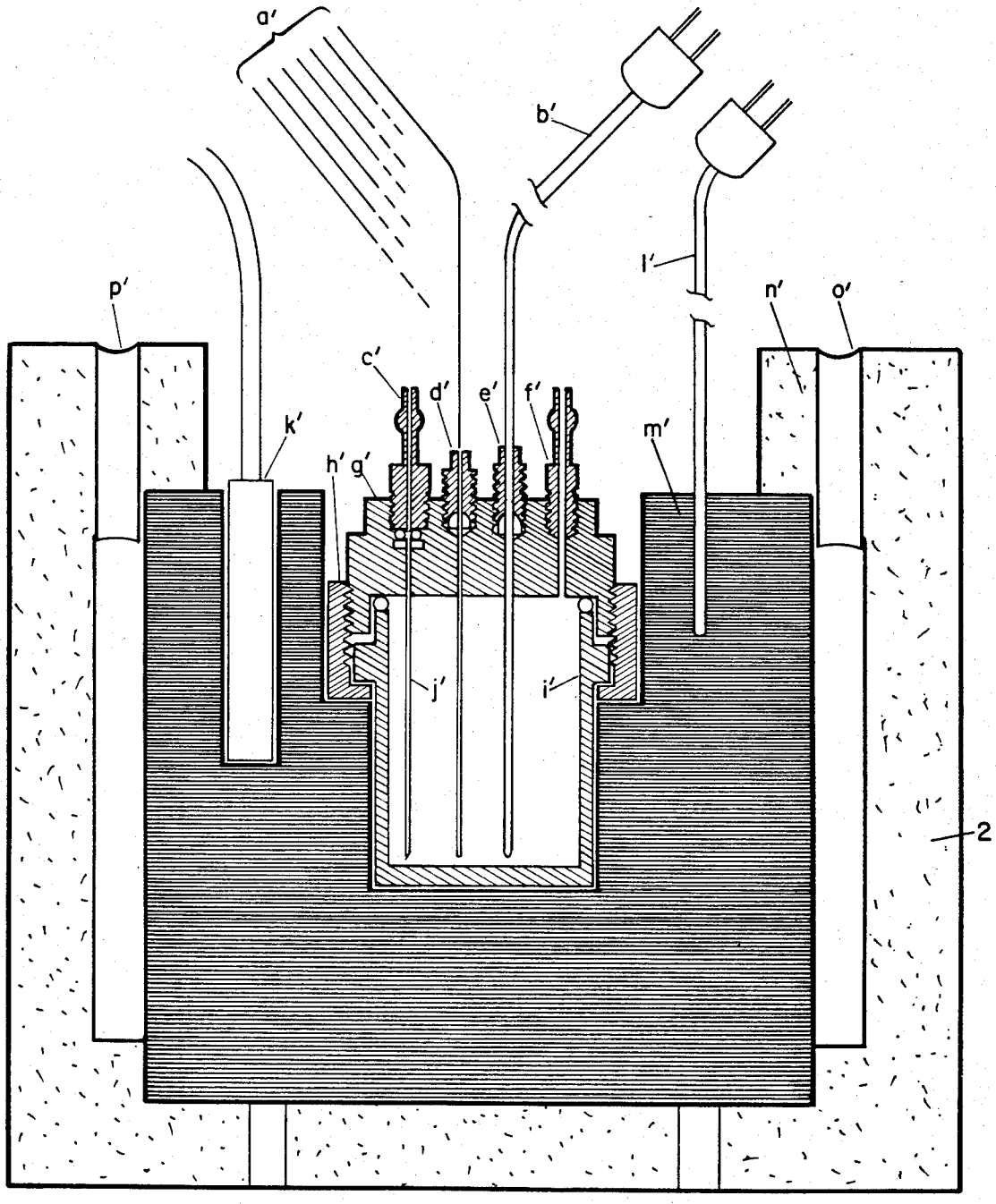
FIG. 3 is a diagrammatic representation of the holding cell in FIG. 1.

The holding cell 2 is shown in detail in FIG. 3, including seven sensing electrodes a', thermocouples b' and l', a liquid transfer fitting c' connected to the transfer tube j', a seal d' for the sensing electrodes, a thermocouple seal e', a vent f', a cell cap g' secured by the brass ring h', the vessel i' which contains the liquid, the heater k', the copper chill block m', Styrofoam insulation n', a quantity of liquid nitrogen o' contained between the Styrofoam wall and the chill block, and a vent p'.

Further modifications of the invention will occur to persons skilled in the art and all such modifications are deemed to be within the scope of the invention as defined by the appended claims.

What is claimed is:

1. A method of electrodeposition of a reactive metal, an elemental semiconductor, a noble or precious metal and compounds and alloys thereof onto a subtrate, that comprises:

establishing an anhydrous ion solution of the material to be deposited in a liquid electrolyte consisting of a mixture taken from the group consisting of liquid halides and halogens having an appropriate electrical conductance and said material;

immersing electrodes in the ion solution; and establishing an electrical potential between the electrodes to attract material ions in the solution to one of the electrodes which serves as a substrate for deposition.

2. A method of electrodeposition according to claim 1 in which the liquid electrolyte is the liquid halide anhydrous hydrogen chloride to which is added tetramethyl ammonium and potassium chlorides to enhance the electrical conductivity of the solution and a soluble salt of the material to be electrodeposited.

3. A method according to claim 2 in which the material to be deposited is the reactive metal Nb and the salt of the material to be electrodeposted is $KNbCl_6$.

4. A method according to claim 2 in which the solution is maintained at a temperature in the range between about 150 degrees K and 200 degrees K.

5. A method according to claim 2 in which said electric potential is maintained with respect to a reference electrode immersed in the ion solution.

6. A method according to claim 2 in which material is electrodeposited under conditions of controlled current.

7. A method according to claim 2 in which the substrate is taken from the group consisting of tantalum, copper, nickel and platinum.

8. A method according to claim 2 in which the material to be electrodeposited is the reactive metal Zr and the soluble salt of the material to be electrodeposited is $K_2ZrCl_6$.

9. A method according to claim 2 in which the material to be electrodeposited is the elemental semiconductor Si and the soluble salt of the material to be electrodeposited is $K_2SiCl_6$.

10. A method of electrodeposition according to claim 1 in which the electrolyte is the liquid interhalogen chlorine monofluoride.

11. A method according to claim 10 in which the substrate is the same material as the material electrodeposited thereon.

12. A method of electrodeposition according to claim 1 in which the electrolyte is the liquid halide boron trifluoride.

13. A method of electrodeposition according to claim 1 in which the reactive material to be electrodeposited is a metal taken from the group consisting of Ti, Zr, Hf, V, Nb, Ta, Cr, Re, Mo and W.

14. A method of electrodeposition according to claim 13 in which a plurality of reactive metals is simultaneously deposited onto the substrate.

15. A method of electrodeposition according to claim 13 in which the substrate consists of the same metal or metals as the reactive metal or metals respectively deposited thereon.

16. A method of electrodeposition according to claim 1 in which the material to be electrodeposited is an elemental semiconductor taken from the group Si, Ge, B, P, Ga, As and gray Sn.

17. A method of electrodeposition according to claim 16 in which a plurality of elemental semiconductors, with or without their principal dopants, B, P, Ga, As, Ae, is simultaneously electrodeposited onto the substrate.

18. A method of electrodeposition according to claim 1 in which the substrate is composed of graphite, vitreous carbon or any other electrically conductive form of carbon.

19. A method of electrodeposition according to claim 1 in which the material to be electrodeposited is a noble or precious metal taken from the group consisting of ruthenium, osmium, rhodium, iridium, palladium, and platinum.

20. A method of electrodeposition according to claim 19 in which the material to be deposited includes a plurality of the elements therein listed.

21. A method of electrodeposition according to claim 1 wherein the material to be electrodeposited is the reactive metal niobium, the cathode substrate is niobium, the electrolyte is liquid chlorine monofluoride containing niobium halide and other halide salts, the anode is niobium, and the solution is maintained at a temperature between about 110 degrees K. and 180 degrees K.

22. A method of electrodeposition according to claim 1 in which the material to be electrodeposited is taken from the group of reactive metals consisting of molybdenum (MO), tungsten (W) and titanium (Ti) and in which the liquid electrolyte is liquid chlorine monofluoride (ClF).

23. A method according to claim 22 in which the temperature during electrodeposition is maintained in the range between about 110 degrees K. and 180 degrees K.

24. A method according to claim 1 in which the material to be electrodeposited is a silicide.

25. A method according to claim 24 in which the silicide is taken from the group consisting of $MoSi_2$ and $WSi_2$ to achieve a wear-resistant surface on the substrate.

26. A process for electrodeposition of a material on a substrate that comprises:

establishing an electrolyte taken from the group consisting of anhydrous liquid halogens and anhydrous liquid halides and having an appropriate electrical conductance in a cryogenic environment;

immersing the substrate in the liquid halogen electrolyte, said electrolyte including ions of the material to be deposited and a solute; and establishing an electric field within the electrolyte to effect migration of ions of said material to the substrate where they deposit.

27. A process according to claim 26 in which the electrolyte is a liquid interhalogen.

28. A process according to claim 27 in which the material is a reactive metal.

29. A process according to claim 26 in which the material is an elemental semiconductor.

30. A process according to claim 26 in which the electrolyte is a mixture of halogen and interhalogen.

31. A process according to claim 26 in which the electrolyte is a halogenous compound, a hydrogen halide, or a halide of a group VB element, or a halide of a group IIIB element, or an interhalogen.

32. A process according to claim 26 in which the temperature is held between 50 degrees K. and 500 degrees K., the precise temperature depending on the elecrolyte used.

33. A process according to claim 26 in which the electrolyte is a mixture such as HCl and $BF_3$ and HF.

34. A product produced in accordance with the process of claim 26.

35. A product that comprises:

a layer of a reactive material electrolytically deposited from an anhydrous inorganic ion solution on a substrate that is totally free of thermal damage due to the depositing of the material thereon.

36. A product according to claim 35 wherein the electrolytically deposited reactive material is a metal taken from the group of reactive metals consisting of Ti, Zr, Hf, V, Nb, Cr, Mo, Ta, W and Re or from the group of elemental semiconductors consisting of Si and gray Sn, or from the group of noble or precious metals consisting of Ru, Os, Rh, Ir, Pd, Pt, Ag and Au.

37. A product according to claim 36 in which the substrate is steel.

38. A product according to claim 35 in which the layer of material is electrodeposited onto the substrate at below room temperature.

39. A product according to claim 35 wherein the reactive material is taken from groups IVA through VIA of the periodic table.

40. A product according to claim 39 wherein the layer is greater than about ten micrometers.

41. A product according to claim 35 wherein the material is an elemental semiconductor.

42. A product according to claim 35 wherein the material is a silicide.

43. A process according to claim 31 wherein the halide of the group VB element is taken from the group consisting of $PF_3$ and $SbF_3$.

44. A process according to claim 33 wherein said mixture is taken from the group consisting of HCl, $BF_3$ and HF.

45. A product produced in accordance with the process of claim 1.

46. A process according to claim 31 wherein the hydrogen halide is taken from the group consisting of HF and HCl.

47. A process according to claim 31 wherein the interhalogen is taken from the group consisting of $BrF_3$ and ClF.

48. A method of electrodeposition of a material onto a substrate, that comprises:

establishing an anhydrous ion solution of the material in a liquid electrolyte consisting of a mixture taken from the group consisting of liquid halides and halogens having an appropriate electrical conductance and said material, said material being taken from the group consisting of Zr, Si, Ti, Hf, V, Nb, Ta, Cr, Mo, W, GeB, Re, gray Sn, P, Ga, As, Al, osmium, rhodium, iridium, palladium, platinum, silver, gold and their silicide compounds;

immersing electrodes in the ion solution; and establishing an electrical potential between the electrodes to attract material ions of said material in the solution to one of the electrodes which serves as a substrate for deposition.

49. A method of electrodeposition according to claim 48 in which ion solution is maintained at cryogenic temperature during said electrodeposition.

50. A process according to claim 31 wherein the halide of the group IIIB element is $BF_3$.

51. A process according to claim 27 in which the material is a noble or precious metal.

* * * * *